US007311566B2

(12) United States Patent
Dent

(10) Patent No.: US 7,311,566 B2
(45) Date of Patent: Dec. 25, 2007

(54) ELECTRICAL CONNECTORS

(75) Inventor: Peter Dent, Enfield (GB)

(73) Assignee: Smiths Group PLC, London (GB)

( * ) Notice: Subject to any disclaimer, the term of this patent is extended or adjusted under 35 U.S.C. 154(b) by 0 days.

(21) Appl. No.: 11/222,097

(22) Filed: Sep. 9, 2005

(65) Prior Publication Data

US 2006/0063438 A1 Mar. 23, 2006

(30) Foreign Application Priority Data

Sep. 17, 2004 (GB) ..... 0420666.0

(51) Int. Cl.
*H01R 13/187* (2006.01)

(52) U.S. Cl. ..... 439/843; 439/63

(58) Field of Classification Search ..... 439/63, 439/675, 843

See application file for complete search history.

(56) References Cited

U.S. PATENT DOCUMENTS 2,702,376 A * 2/1955 Brush ..... 439/252
4,519,666 A * 5/1985 Williams et al. ..... 439/578
4,593,464 A * 6/1986 Williams et al. ..... 29/879
4,662,706 A * 5/1987 Foley ..... 439/851
5,217,391 A * 6/1993 Fisher, Jr. ..... 439/578
6,102,746 A * 8/2000 Nania et al. ..... 439/675
6,402,565 B1 * 6/2002 Pooley et al. ..... 439/680
6,443,740 B1 * 9/2002 Evans ..... 439/63
2006/0063438 A1 * 3/2006 Dent ..... 439/843

FOREIGN PATENT DOCUMENTS

GB 1257284 12/1971

OTHER PUBLICATIONS

International Search Report dated Oct. 25, 2005, Appl. No. GB0516843.0, 1 page.

* cited by examiner

*Primary Examiner*—James R. Harvey
(74) *Attorney, Agent, or Firm*—Connolly Bove Lodge and Hutz

(57) ABSTRACT

An electrical connector for high current applications has a mating plug and socket assembly. The socket assembly has two sockets arranged coaxially of one another and electrically interconnected. The central socket receives and contacts a pin on the plug assembly; the other socket contacts the external surface of a tubular sleeve surrounding and integrally electrically connected with the pin. The socket assembly also has a third socket electrically insulated from and arranged coaxially outwardly of the other two sockets. The third socket makes electrical contact with the outer surface of a tubular contact extending coaxially of the pin and electrically insulated from it. The sockets each have a hyperboloid configuration of multiple resilient wires to make contact with the pin, sleeve and outer contact.

14 Claims, 2 Drawing Sheets

ELECTRICAL CONNECTORS

BACKGROUND OF THE INVENTION

This invention relates to electrical connectors and to socket and plug assemblies of such connectors.

The invention is more particularly concerned with electrical connectors capable of handling short duration surges of very high current.

There are some applications where it is necessary to deliver very high currents for short periods. Existing connectors are not generally suitable because they present too high an inductance. Also, the relatively low number of contact points in conventional connectors means that each contact point has to pass a relatively high current with the consequent risk of damage to the connector.

BRIEF SUMMARY OF THE INVENTION

It is an object of the present invention to provide an alternative electrical connector and plug and socket assemblies.

According to one aspect of the present invention there is provided a socket assembly including a first socket arrangement having an inner contact surface provided by first multiple, electrically-conductive, resilient contact elements disposed around the circumference of the socket and arranged electrically to contact the outside of a conductive pin element of a plug assembly inserted within the socket, the assembly including a second socket arrangement electrically connected with the first socket arrangement and located coaxially externally of the first socket arrangement to define an annular recess therebetween, the second socket arrangement including second multiple, electrically-conductive, resilient contact elements arranged around the socket and arranged to contact a surface of a tubular conductive element of the plug assembly extending coaxially of and electrically connected with the pin element such that current can flow between the socket assembly and the plug assembly via both the first and second electrically-conductive contact elements.

The second conductive resilient contact elements are preferably arranged to contact an external surface of the tubular conductive element. The resilient contact elements are preferably provided by a hyperboloid configuration of resilient wires. The first resilient contact elements may be mounted at one end of a cylindrical metal component, the opposite end of the metal component having a tubular opening in which an electrical wire is received. The socket assembly preferably includes a third socket arrangement located coaxially externally of the second socket arrangement and electrically insulated from the first and second socket arrangements, the third socket arrangement being arranged electrically to interconnect with a second tubular element extending coaxially of and electrically insulated from the first tubular element and the pin. The third socket arrangement may include multiple, electrically-conductive resilient contact elements disposed around the third socket arrangement and arranged electrically to contact the second tubular element. The contact elements of the third socket arrangement are preferably provided by a hyperboloid configuration of resilient wires. The contact elements of the third socket arrangement may be mounted at one end of a cylindrical metal component, the opposite end of the cylindrical metal component being arranged to make connection with an electrical wire. The third socket arrangement is preferably arranged to contact an external surface of the second tubular element.

According to a second aspect of the present invention there is provided a socket assembly comprising three sockets arranged coaxially one within the other, two of the sockets being electrically connected with one another and a third of the sockets being electrically insulated from the others.

According to a third aspect of the present invention there is provided a plug assembly of an electrical connector including a first metal component having at one end a cylindrical pin element the external surface of which provides a first contact surface, a tubular sleeve formed with the metal component and extending coaxially around the pin element to provide an annular recess therebetween, the surface of the tubular sleeve providing a second contact surface, a second metal component extending coaxially around the first metal component and having a surface providing a third contact surface and insulating means located between the first and second metal components such that the first and second metal components are electrically insulated from one another.

According to a fourth aspect of the present invention there is provided a plug assembly for connection with a socket assembly according to the above one, second or third aspect of the present invention.

The plug assembly preferably includes an integral metal component having a central rod-like pin and a coaxial outer sleeve arranged to make electrical connection with the first and second contact elements respectively.

According to a fifth aspect of the present invention there is provided a connector assembly comprising two mating components each including a first and second electrical contact arrangement arranged coaxially one within the other and an insulating member disposed therebetween, the first contact arrangement in both components including two contacts electrically connected with one another and arranged coaxially one within the other such that when the two mating components are mated with one another, electrical connection of the respective first contact arrangements is established via both respective contacts.

An electrical connector according to the present invention will now be described, by way of example, with reference to the accompanying drawings.

DETAILED DESCRIPTION OF THE PREFERRED EMBODIMENT

The connector comprises a female, socket assembly 1 and a male, pin or plug assembly 2 adapted to mate with one another and establish electrical interconnection along two paths: an outgoing path and a return path. The construction of the connector is such that it can reliably pass surge currents of up to about 300 KA for 5 ms.

Figure 1:
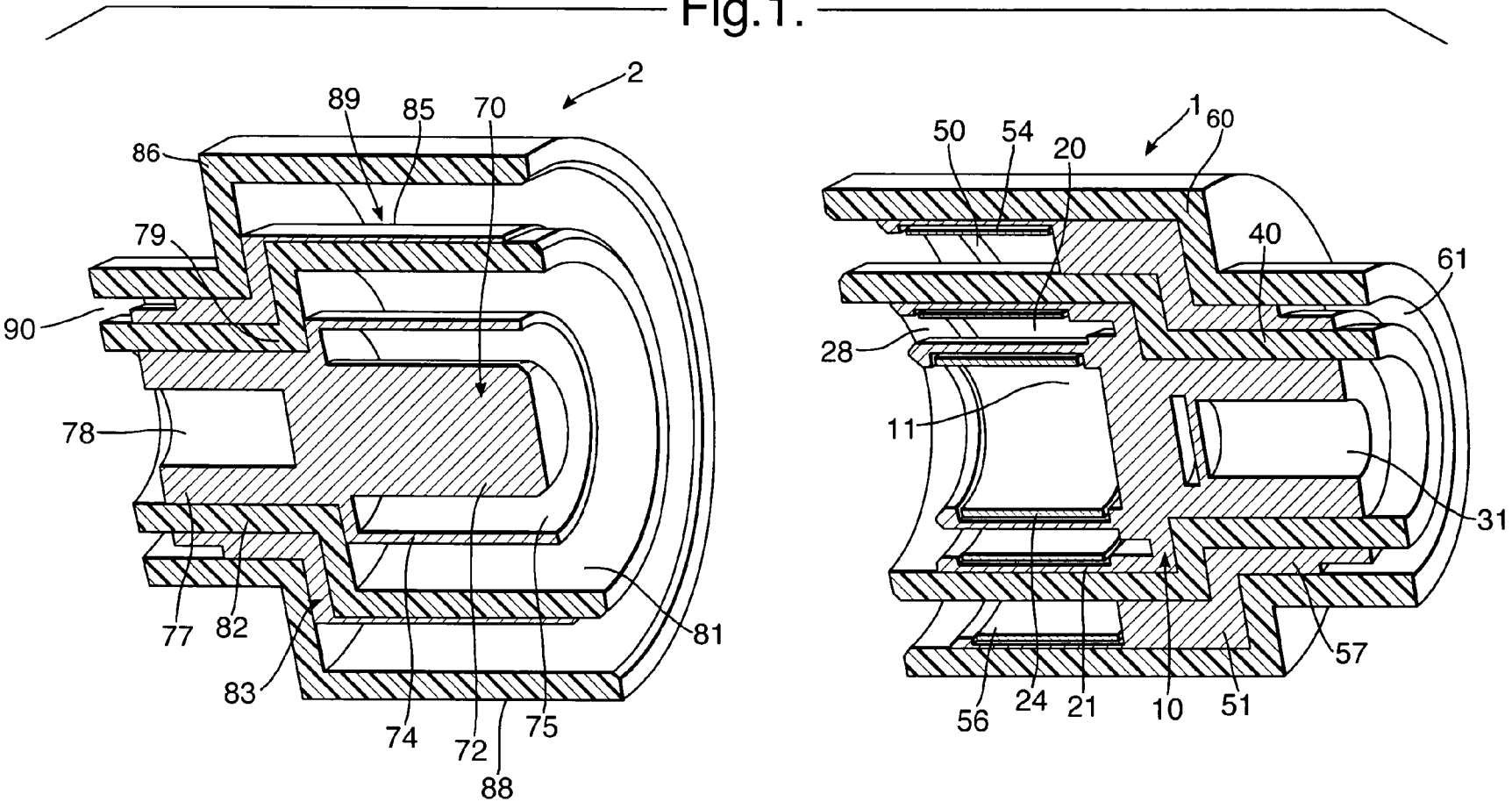
FIG. 1 is a cut-away perspective view of the connector.
Figure 2:
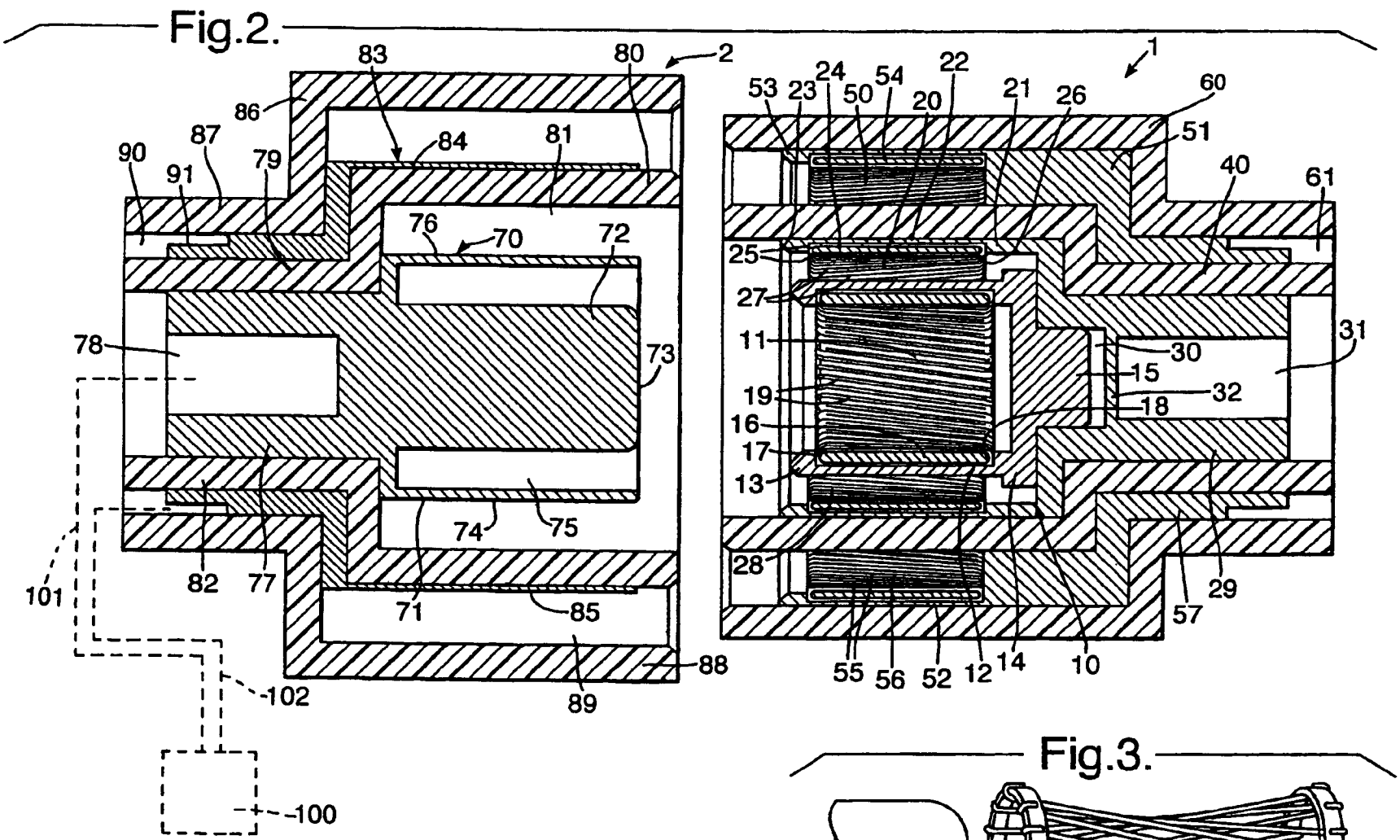
FIG. 2 is a cross-sectional side elevation view of the connector.
Figure 3:
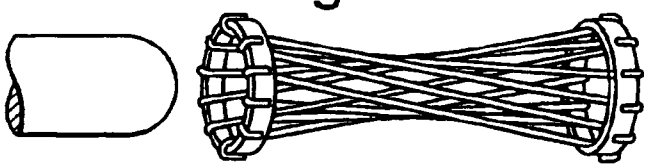
FIG. 3 is a perspective view illustrating a hyperboloid socket.

The socket assembly 1 has an inner electrically-conductive sub-assembly 10 of a metal such as copper alloy. The sub-assembly 10 provides an inner socket 11 and an intermediate socket 20. The inner socket 11 has a machined collar 12 of cylindrical, tubular shape and circular section with an open forward end 13 and a closed rear end 14 formed with an axially protruding boss 15. Inside, the collar 12 retains a metal support sleeve 16, which is trapped between forward and rear shoulders 17 and 18 on the inner surface of the collar. The sleeve 16 supports multiple, resilient electrical contact wires 19 extending along the inner surface of the sleeve and arranged in a hyperboloid fashion, with their ends wrapped around the ends of the sleeve and trapped between the outside of the sleeve and the inside of the collar 12. Hyperboloid wire sockets are available from Hypertac Limited of London, England and Hypertronics, Inc of Hudson, Mass., USA. The principle of operation of these sockets is illustrated in FIG. 3 and is described in, for example, U.S. Pat. Nos. 3,107,966, 3,470,527 and 6,102,746. Alternative resilient contact elements could be used, which may be provided by resilient regions of a unitary component, such as the Contact Bands sold by Icore International Limited of Slough, England.

The intermediate socket 20 is of annular shape and is provided coaxially around the outside of the inner socket 11. The intermediate socket 20 is formed by an outer machined shell 21 of cylindrical shape having a forward portion 22 coaxially surrounding the inner socket 11 and open at its forward end 23. The forward portion 22 retains a metal support sleeve 24, similar to the sleeve 16 in the inner socket 11, which is trapped between forward and rearward shoulders 25 and 26. The support sleeve 24 supports multiple hyperboloid wires 27 arranged in the same fashion as in the inner socket 11 so that the wires extend over the inwardly-facing surface of the socket 20. Typically there are a total of about 150 contact wires 19 and 27 in the inner sub-assembly 10. The diameters of the inner and intermediate sockets 11 and 20 are such that there is an annular recess 28 between the outside of the inner socket and the inside of the intermediate socket. The shell 21 is stepped about midway along its length to provide a rear portion 29 of reduced diameter and a forwardly-facing recess 30 into which the boss 15 of the inner socket 11 is affixed. The rear portion 29 opens at its rear end from a rearwardly-facing recess 31 into which a wire (not shown) can be connected by any conventional means. The two recesses 30 and 31 are separated from one another by a partition wall 32.

The intermediate socket 20 is surrounded by an outer tubular sleeve 40 of a non-conducting, dielectric material, such as a temperature-resistant plastics or a ceramics. The sleeve 40 projects beyond the intermediate socket 20 at both ends.

The socket assembly 1 also includes a third, outer socket 50, separate from the sub-assembly 10 and electrically insulated from it by the dielectric sleeve 40. The third socket 50 includes a machined shell 51 having a forward portion 52 located coaxially and externally of the inner socket 11 and the intermediate socket 20. The forward end 53 of the forward portion 52 is open and retains a support sleeve 54 and a hyperboloid arrangement of multiple contact wires 55 in the same manner as in the other sockets 11 and 20. Typically, there would be about 150 contact wires 55 in the outer socket 50. The wires 55 are exposed for contact on the inner surface of the socket 50. The diameter of the forward portion 52 is such that there is an annular recess 56 between the outside of the dielectric sleeve 40 and the inside of the forward portion 52. The shell 51 is stepped about two thirds the way rearwardly along its length to a rear portion 57 of smaller diameter, the inner surface of the shell 51 conforming to the external shape of the dielectric sleeve 40.

The socket assembly 1 is completed by an outer, electrically-insulating jacket 60 of a dielectric material. The outer jacket 60 projects beyond the opposite ends of the outer shell 51, terminating level with the dielectric sleeve 40 at both ends. The jacket 60 forms an annular recess 61 with the rear end of the dielectric sleeve 40; the outside of the rear end 57 of the shell 51 is stepped to provide a location for connection of a wire.

The pin assembly 2 includes an integral, inner conductive component 70 of generally cylindrical shape and machined from stainless steel or the like. The forward portion 71 of the component 70 has a solid, inner, cylindrical, rod-like first male pin 72 of circular section and with a rounded edge 73. The external diameter of the first, inner pin 72 is such as to make a sliding contact with the contact wires 19 in the inner socket 11 when the pin and socket assemblies 1 and 2 are mated. A sleeve 74 of tubular form coaxially surrounds the pin 72 and is formed integrally as one piece with the pin, being spaced radially from it at one end to form an annular recess 75. The outer surface 76 of the sleeve 74 forms a second, intermediate pin element the diameter of which is such that it makes a sliding electrical contact with the wires 27 in the intermediate socket 20 when the pin and socket assemblies 1 and 2 are mated together. The rear portion 77 of the inner component 70 is stepped to a slightly smaller external diameter than the sleeve 74 and has a rearwardly-facing cylindrical recess 78 formed in it to receive an electrical wire 101.

An electrically-insulative, dielectric sleeve 79 surrounds the inner component 70. At its forward end 80 the internal diameter of the sleeve 79 is greater than the external diameter of the inner component 70 so that an annular recess 81 is defined between them. The rear portion 82 of the dielectric sleeve 79 is stepped to a reduced diameter and conforms to the external surface of the rear portion 77 of the inner component. 70. The dielectric sleeve 79 projects beyond both ends of the inner component 70.

The dielectric sleeve 79 is surrounded by a second, outer electrically-conductive, metal male, pin component 83 in the form of a stepped tube conforming to the external surface 84 of the dielectric sleeve 79. The external surface 85 at the forward portion of the outer, tubular pin component 83 provides an outer male, pin of the assembly 2 and is arranged to make a sliding electrical contact with the contact wires 55 in the outer, female socket 50. The pin assembly 2 is completed by an outer, electrically-insulative dielectric jacket 86 attached at its rear end 87 with the outside of the outer pin component 83. The forward portion 88 of the dielectric jacket 86 has an increased diameter, its internal diameter being greater than the external diameter of the outer pin component 83 so that an annular recess 89 is provided to receive the outer jacket 60 and outer socket 50 of the socket assembly 1 when the two assemblies are mated together. The dielectric jacket 86 projects level with the inner dielectric sleeve 79 at both ends, a short distance beyond the ends of the two conductive components 70 and 83. An annular recess 90 is also provided between the dielectric sleeve 79 and the dielectric jacket 86 at the rear end of the pin assembly 2, the outer pin component 83 being formed with a step 91 on its external surface to provide a location for connection of a wire 102.

The pin contact assembly 2 is connected to a very high surge current supply 100 by means of the wire 101 connected to the inner pin component 70, which provides the negative current connection, and by a wire 102 connected to the outer pin component 83, which provides the positive current connection. Similarly, wires connected to the inner sub-component 10 and the shell 51 in the socket assembly 1 provide the negative and positive connections between the socket assembly 1 and the equipment to which the current is applied.

The pin and socket assemblies 2 and 1 are mated with one another by aligning their forward ends and pushing them together. In this way, the external surface 85 of the outer pin component 83 in the pin assembly 2 makes a sliding wiping seal with the contact wires 55 in the outer socket 50 so that electrical connection of the outer, positive voltage components of the two assemblies 1 and 2 is established. Similarly, negative electrical connection is established both by contact of the external surface 76 of the sleeve 74 with the contact wires 27 in the intermediate socket 20 and by contact of the external surface of the pin 72 with the contact wires 19 in the inner socket 11. When fully mated, two connections are formed between the inner contacts 10 and 70, and one connection between the outer contacts 51 and 83, and these three connections are located coaxially within one another. This coaxial configuration is important because it minimizes the profile, or length, of the mated contact assemblies 1 and 2 and thereby keeps its inductance low. The mated connector establishes electrical connection via 150 contact wires for each polarity so that there are a large number of individual contact asperities for each polarity, thereby minimizing the current flow at each contact asperity and reducing the risk of damage caused by high current flow. The number of contact wires 19 and 27 for the inner contact is maximized by providing two sockets 11 and 20 one within the other. Because of the greater circumference of the outer socket 50, the same number of wires 55 can be accommodated in a single socket.

Various different configurations of socket are possible. For example, instead of contacting the external surface 76 of the sleeve 74 it would be possible for contact wires in the socket assembly to be mounted on an externally-facing surface so as to contact the inner surface of the sleeve. It is, however, usually preferable for the contact wires to be mounted on an internally-facing surface because this provides a greater circumference and enables a greater number of wires to be accommodated.

What I claim is:

1. A socket assembly comprising:

a first socket arrangement having an inner contact surface provided by first multiple, electrically-conductive, resilient contact elements disposed around the circumference of the socket and arranged electrically to contact the outside of a conductive pin element of a plug assembly inserted within the socket; and a second socket arrangement electrically connected within said socket assembly with said first socket arrangement and located coaxially externally of said first socket arrangement to define an annular recess therebetween, wherein said second socket arrangement includes second multiple, electrically-conductive, resilient contact elements arranged around the socket in said annular recess and arranged to contact a surface of a tubular conductive element of said plug assembly inserted within said annular recess, said tubular conductive element extending coaxially to and electrically connected within said plug assembly with said pin element such that current can flow between the socket assembly and the plug assembly via both the first and second electrically-conductive contact elements.

2. A socket assembly according to claim 1, wherein said second conductive resilient contact elements are arranged to contact an external surface of said tubular conductive element.

3. A socket assembly according to claim 1, wherein said resilient contact elements are provided by a hyperboloid configuration of resilient wires.

4. A socket assembly comprising:

a first socket arrangement having an inner contact surface provided by first multiple, electrically-conductive, resilient contact elements disposed around the circumference of the socket and arranged electrically to contact the outside of a conductive pin element of a plug assembly inserted within the socket;

a second socket arrangement electrically connected within said socket assembly with said first socket arrangement and located coaxially externally of said first socket arrangement to define an annular recess therebetween, wherein said second socket arrangement includes second multiple, electrically-conductive, resilient contact elements arranged around the socket and arranged to contact a surface of a tubular conductive element of said plug assembly extending coaxially to and electrically connected within said plug assembly with said pin element such that current can flow between the socket assembly and the plug assembly via both the first and second electrically-conductive contact elements; and a third socket arrangement located coaxially externally of said second socket arrangement and electrically insulated from said first and second socket arrangements, and wherein said third socket arrangement is arranged electrically to interconnect with a second tubular element extending coaxially with and electrically insulated from said first tubular element and said pin.

5. A socket assembly according to claim 4, wherein said third socket arrangement includes multiple, electrically-conductive resilient contact elements disposed around said third socket arrangement and arranged electrically to contact said second tubular element.

6. A socket assembly according to claim 5, wherein said contact elements of said third socket arrangement are provided by a hyperboloid configuration of resilient wires.

7. A socket assembly according to claim 5, wherein said contact elements of said third socket arrangement are mounted at one end of a cylindrical metal component, and wherein an opposite end of said cylindrical metal component is arranged to make connection with an electrical wire.

8. A connector assembly comprising two mating components each including:

a first electrical contact arrangement and a second electrical contact arrangement arranged coaxially one within the other; and an insulating member disposed between said first electrical contact arrangement and said second electrical contact arrangment, wherein said first contact arrangement in both of said two mating components includes two contacts electrically connected with one another within a respective one of said two mating components and arranged coaxially one within the other such that when said two mating components are mated with one another, electrical connection of said respective first contact arrangements is established via both said respective contacts, and wherein said contacts in one of said two mating components are provided by a first socket and a second annular socket extends coaxially around the first socket, and wherein said contacts in another of said two mating components are provided by male components within the other.

9. An assembly according to claim 8, wherein at least one of said contact arrangements in one of said two mating components includes a hyperboloid configuration of resilient wires.

10. An assembly according to claim 8, wherein both of said contacts of said first contact arrangement of one of said two mating components are arranged electrically to contact external surfaces of both of said contacts of said first contact arrangement of another of said two mating components.

11. A plug assembly of an electrical connector comprising:

a first metal component having at one end a cylindrical pin element, said pin element having an external surface providing a first contact surface, and a tubular sleeve formed with the metal component and extending coaxially around and along said pin element to provide an annular recess therebetween within which a cooperating contact is received, a surface of said tubular sleeve providing a second contact surface electrically connected within the connector with said first contact surface;

a second metal component extending coaxially around and along said first metal component and having a surface providing a third contact surface; and an insulating member located between said first and second metal components such that said first and second metal components are electrically insulated from one another.

12. A socket assembly comprising:

a first socket arrangement having an inner contact surface provided by first multiple, electrically-conductive, resilient contact elements disposed around the circumference of the socket and arranged electrically to contact the outside of a conductive pin element of a plug assembly inserted within the socket, wherein said resilient contact elements are mounted at one end of a cylindrical metal component, and further wherein an opposite end of said metal component has a tubular opening in which an electrical wire is received; and a second socket arrangement electrically connected within said socket assembly with said first socket arrangement and located coaxially externally of said first socket arrangement to define an annular recess therebetween, wherein said second socket arrangement includes second multiple, electrically-conductive, resilient contact elements arranged around the socket and arranged to contact a surface of a tubular conductive element of said plug assembly extending coaxially to and electrically connected within said plug assembly with said pin element such that current can flow between the socket assembly and the plug assembly via both the first and second electrically-conductive contact elements.

13. A socket assembly according to claim 4, wherein said third socket arrangement is arranged to contact an external surface of said second tubular element.

14. A plug assembly of an electrical connector comprising:

a first metal component having at one end a cylindrical pin element, said pin element having an external surface providing a first contact surface, and a tubular sleeve formed with the metal component and extending coaxially around said pin element to provide an annular recess therebetween, an outer surface of said tubular sleeve providing a second contact surface electrically connected within the connector with said first contact surface;

a second metal component extending coaxially around said first metal component and having a surface providing a third contact surface; and an insulating member located between said first and second metal components such that said first and second metal components are electrically insulated from one another.

* * * * *